US005794592A

United States Patent [19]

Fukui

[11] Patent Number: 5,794,592

[45] Date of Patent: Aug. 18, 1998

[54] INTERNAL COMBUSTION ENGINE CONTROLLER

[75] Inventor: Wataru Fukui, Tokyo, Japan

[73] Assignee: Mitsubishi Denki Kabushiki Kaisha, Tokyo, Japan

[21] Appl. No.: 890,665

[22] Filed: Jul. 9, 1997

[30] Foreign Application Priority Data

Feb. 7, 1997 [JP] Japan ..... 9-025483

[51] Int. Cl.[6] ..... F02P 5/00

[52] U.S. Cl. ..... 123/414

[58] Field of Search ..... 123/414, 416, 123/417, 418, 422, 423

[56] References Cited

U.S. PATENT DOCUMENTS

| | | | |
|---|---|---|---|
| 5,584,274 | 12/1996 | Fukui et al. | 123/414 |
| 5,632,246 | 5/1997 | Fukui et al. | 123/414 |
| 5,671,714 | 9/1997 | Fukui et al. | 123/414 |
| 5,715,791 | 2/1998 | Fukui et al. | 123/414 |

FOREIGN PATENT DOCUMENTS

| | | | |
|---|---|---|---|
| 58-220963 | 12/1983 | Japan | 123/41 C |

*Primary Examiner*—Raymond A. Nelli

*Attorney, Agent, or Firm*—Sughrue, Mion, Zinn, Macpeak & Seas, PLLC

[57] ABSTRACT

In an internal combustion engine controller, a crank angle signal SGTP includes pulses corresponding to first and second reference crank angles and a cylinder identification signal SGCP includes a pulse having a phase difference to the crank angle signal, the pulse number of a specific cylinder from the second reference crank angle to the first reference crank angle is different from those of other cylinders, a control/arithmetic operation circuit includes means for calculating control timings, means for counting the pulse number of the cylinder identification signal, means for outputting a cylinder identification flag FC by assessing a cylinder identifying state based on a count value CP and a previous count value CPO and means for reflecting the cylinder identification flag to the output state of drive signals and control reflection means prohibits the output of the drive signals when the cylinder identification flag is abnormal. With this arrangement, the internal combustion engine controller is capable of avoiding the erroneous control of the internal combustion engine can be obtained without an increase in a cost.

5 Claims, 12 Drawing Sheets

INTERNAL COMBUSTION ENGINE CONTROLLER

BACKGROUND OF THE INVENTION

1. Field of the Invention

The present invention relates to an internal combustion engine controller for controlling the ignition of respective cylinders by supplying a low voltage, and more specifically, to an internal combustion engine controller capable of securing an excellently controlled state by preventing the erroneous control of the respective cylinders caused by abnormal rotation such as reverse rotation and the like at start.

2. Description of the Related Art

FIG. 9 is a view showing the arrangement of a conventional internal combustion engine controller described in, for example, Japanese Examined Patent Publication No. 62-36153 and the like. FIG. 10 is a timing chart showing the output waveform of an angle sensor in FIG. 9 and FIG. 11 is a flowchart showing cylinder discriminating operation executed by the conventional controller shown in FIG. 9 and FIG. 12 and FIG. 13 are timing charts showing erroneous control operation executed by the conventional controller.

In FIG. 9, an angle sensor 10 disposed to the crank shaft or the cam shaft (not shown) of an internal combustion engine detects the rotational angle of the internal combustion engine and individually outputs a crank angle signal SGT showing the reference crank angle of each of cylinders and a cylinder identification signal SGC for identifying each of the cylinders.

Usually, the angle sensor 10 includes a crank angle sensor and a cylinder identification sensor (now shown). The crank angle sensor of the sensors for creating the crank angle signal SGT is disposed to the crank shaft and the cylinder identification sensor of them for creating the cylinder identification signal SGC is disposed to the cam shaft whose rotations are reduced to one half those of the crank shaft.

Various sensors 12 including an amount of intake air sensor, a water temperature sensor, a start switch and the like detect the operating state D of the internal combustion engine and create various detection signals showing the operating state D.

Injectors 16 disposed in correspondence to the respective cylinders of the internal combustion engine inject a predetermined amount of fuel by driving the fuel injection valves of the respective cylinders at predetermined timings.

Ignition coils 18*a* and 18*b* disposed in correspondence to each of the cylinders of the internal combustion engine are composed of a transformer including a primary winding and a secondary winding and a high ignition voltage is imposed on the ignition plug 20 of each cylinder from the secondary winding.

The case shown above is arranged such that a pair of the ignition coils 18*a* and 18*b* are provided and the ignition plugs 20 of the #1 and #4 cylinders are connected to the respective one ends of one of the ignition coils or the ignition coil 18*a* and the ignition plugs 20 of the #3 and #2 cylinders are connected to the respective one ends of the other of the ignition coils or the ignition coil 18*b*. Therefore, the respective one pairs of the cylinders; that is, the #1 and #4 cylinders and the #3 and #2 cylinders are simultaneously ignited, respectively.

Power transistors 22*a* and 22*b* connected in series to the primary windings of the respective ignition coils 18*a* and 18*b* shut off primary currents i1*a* and i1*b* flowing to the respective primary windings and generate an increased high voltage from the secondary windings of the respective ignition coils 18*a* and 18*b*.

An ECU (electronic control unit) 30 composed of a microcomputer includes an input interface 32, a control/arithmetic operation circuit 34 and an output interface 36. The input interface 32 fetches the crank angle signal SGT, the cylinder identification signal SGC and the operating state D and inputs them to the control/arithmetic operation circuit 34.

The control/arithmetic operation circuit 34 calculates the respective control timings of the injectors 16 and the ignition coils 18*a* and 18*b* based on the various types of information SGT, SGC and D through the input interface 32 and creates drive signals to respective actuators, that is, drive signals J1–J4 to the respective injectors 16 and drive signals P1 and P2 to the ignition coils 18*a* and 18*b* according to the respective control timings.

The output interface 36 outputs the drive signals J1–J4 and drives the injectors 16 of the respective cylinders as well as outputs the drive signals P1 and P2 to thereby drive the power transistors 22*a* and 22*b*.

That is, the drive signal P1 to the ignition coil 18*a* (base current of the power transistor 22*a*) intermittently turns on the power transistor 22*a* to thereby shut off the primary current i1*a* supplied to the ignition coil 18*a* and the drive signal P2 to the ignition coil 18*b* (base current of the power transistor 22*b*) intermittently turns on the power transistor 22*b* to thereby shut off the primary current i1*b* supplied to the ignition coil 18*b*.

In FIG. 10, the crank angle signal SGT is composed of a pulse signal according to the rotation of the crank shaft and the rising edges of respective pulses show a first reference crank angle B75° (75° this side from TDC) corresponding to the respective cylinders (#1–#4) and the falling edges thereof show a second reference crank angle B5° (5° this side from TDC).

Note, the first reference crank angle B75° corresponds to the timing at which initial current supply starts and the second reference crank angle B5° corresponds to the timing at which initial ignition is executed in the vicinity of a compression upper dead point.

The cylinder identification signal SGC has pulses offset from the pulses of the crank angle signal SGT which corresponds to the #1 and #4 cylinders and generates a level (H, L) at the respective edges (first and second reference crank angles) of the crank angle signal SGT in a predetermined sequence to thereby specify the respective cylinders (#1–#4 cylinders).

Therefore, the #1 and #4 cylinders can be identified by the level "1" of the cylinder identification signal SGC at the rising edges of the crank angle signal SGT (first reference crank angle) B75° and a specific cylinder, that is, the #1 cylinder can be identified by the level "1" of the cylinder identification signal SGC at the falling edge of the crank angle signal SGT (second reference crank angle) B5°.

Next, operation of the conventional internal combustion engine controller shown in FIG. 9 will be described with reference to FIG. 10 and FIG. 11.

Since the level of the cylinder identification signal SGC at the first reference crank angle 75° (see FIG. 10) alternately changes to the H and L levels in ordinary operation, the control/arithmetic operation circuit 34 can identify a group of cylinders which is simultaneously ignited (group sparking).

Further, since the level of the cylinder identification signal SGC at the second reference crank angle B5° is set to the H level only to the specific cylinder (#1 cylinder), the control/arithmetic operation circuit 34 can identify the specific cylinder.

Note, when the cylinder identification signal SGC has a pattern set as shown in FIG. 10, the respective cylinders can be also specified from the levels of the cylinder identification signal SGC at the pair of edges B5° and B75° of the respective pulses of the crank angle signal SGT.

That is, when the levels of the cylinder identification signal SGC at the respective reference crank angles B5° and B75° are "0, 1", "the #1, #4 cylinders" are specified (however, when the level at the next edge B5° is "1", the #1 cylinder is specified), when the levels are "1, 0", "the #3 cylinder" is specified, and when the levels are "0, 0", "the #2 cylinder" is specified as a corresponding cylinder or cylinders, respectively.

In FIG. 11 showing the cylinder identifying operation, first, the control/arithmetic operation circuit 34 in the ECU 30 determines whether the rising edge of the crank angle signal SGT (reference crank angles B75°) is input at present or not (step S1) and if the reference crank angle B75° is input, (that is, YES), the control/arithmetic operation circuit 34 determines whether the level of the cylinder identification signal SGC is "1" or not (step S2).

If it is determined that the level of the cylinder identification signal SGC at the reference crank angles B75° is "1" (that is, YES), it is recognized that the crank angle signal SGT at present is located at B75° of the #1 or #4 cylinder (step S3) and the process returns.

Whereas, if it is determined at step S2 that the level of the cylinder identification signal SGC at the reference crank angle B75° is not "1" (that is, NO), it is recognized that the crank angle signal SGT is located at B75° of the #2 or #3 cylinder (step S4) and the process returns.

On the other hand, if it is determined at step S1 that the reference crank angles B75° is not input (that is, NO), it is subsequently determined whether the falling edge of the crank angle signal SGT (the reference crank angle B5°) is input at present or not (step S5).

If it is determined that the reference crank angle B5° is input (that is, YES), it is determined whether the level of the cylinder identification signal SGC at the time is "1" or not (step S6) and if it is determined that the level is "1" (that is, YES), it is recognized that the crank angle signal SGT at present is located at B5° of the #1 cylinder (step S7) and the process returns (step S7).

Whereas, if it is determined that the level of the cylinder identification signal SGC at the reference crank angle B5° is not "1" (that is, NO), no cylinder is specified and the process returns as it is.

When the respective cylinders are identified as described above, the control/calculation circuit 34 detects the operating state of the internal combustion engine based on the crank angle signal SGT and the cylinder identification signal SGC from the angle sensor 10, the operating state detection signal D from the various sensors 12 as well as calculates the control parameters (timing at which fuel is injected, ignition timing and the like) of each cylinder using the respective reference crank angles B75° and B5° as control references.

Therefore, the drive signals J1–J4 to the injectors 16 are sequentially created in correspondence to the respective cylinders at optimum control timings according to the operating state of the internal combustion engine and the drive signal P1 to the power transistor 22*a* (ignition coil 18*a*) and the drive signal P2 to the power transistor 22*b* (ignition coil 18*b*) are alternately created to the respective groups of the cylinders.

The power transistors 22*a* and 22*b* are alternately turned on by the drive signals P1 and P2 to thereby shut off the primary currents i1*a* and i1*b* supplied to the respective ignition coils 18*a* and 18*b*, so that the ignition plugs 20 of the respective cylinders are sequentially discharged for ignition control.

Usually, the timings at which the primary currents i1*a* and i1*b* are shut off (ignition timings) are set to the vicinity of the second reference crank angle B5°, that is, to the vicinity of a compression upper dead point.

Further, the control/arithmetic operation circuit 34 does not execute the timer control using the respective reference crank angles B75° and B5° as start points when the internal combustion engine starts operation or when the internal combustion engine operates at a low rotational speed in which the crank angle signal SGT makes a large amount of cyclic variation but executes bypass control in which the supply of the primary currents i1*a* and i1*b* is started at the first reference crank angle B75° and the supply is shut off at the second reference crank angle B5°.

The control/arithmetic operation circuit 34 controls the injectors 16 and the ignition coils 18*a* and 18*b* of the respective cylinders at optimum timings according to the operating state.

However, if a start switch is turned off during a compression stroke (at a crank angle position this side of an upper dead point) by the operation mistake of an operator at the start of the engine before the internal combustion engine completely finishes its starting operation, the internal combustion engine stops by being reversed.

In this case, since the control/arithmetic operation circuit 34 cannot recognizes the reverse rotation, it erroneously shuts off the primary current i1 (i1*a* or i1*b*). Thus, there is a possibility that the internal combustion engine is damaged.

For example, when the internal combustion engine is reversed at a time t2 just after it passes through the first reference crank angle B75° of the #1 cylinder in normal rotation (during a compression stroke) as shown in FIG. 12, the control/arithmetic operation circuit 34 starts to supply of the primary current i1*a* to the #1 cylinder at the first reference crank angle B75° (time t1) in the normal rotation and then misidentifies the first reference crank angle B75° (time t3) after the reverse rotation (time t2) as the second reference crank angle B5° and ignites the ignition plug at an excessively advanced angle by shutting off the primary current i1*a*.

Further, the internal combustion engine is reversed at a time t4 just after it passes through the second reference crank angle B5° of the #4 cylinder in normal rotation (during a compression stroke) as shown in FIG. 13, the control/arithmetic operation circuit 34 starts to supply the primary current i1*b* to the #2 cylinder by misidentifying the second reference crank angle B5° (time t5) after reverse rotation (time t4) as the first reference crank angle B75° of the #2 cylinder.

Since the conventional internal combustion engine controller takes no countermeasure for preventing the misidentification of the reference crank angles and the respective cylinders when reverse rotation (abnormal rotation) is caused by the turning-off of a start switch (erroneous operation) and the like at start as described above, there is a problem that an unstable combustion state is caused by the ignition executed at an excessively advanced angle (see FIG. 12), the erroneous supply of a current (see FIG. 13) and the like, by which the internal combustion engine is adversely affected.

An object of the present invention made to solve the above problem is to provide an internal combustion engine controller capable of maintaining an excellently controlled state by securing the reliability in the identification of cylinders at start without increasing a cost.

SUMMARY OF THE INVENTION

An internal combustion engine controller according to the present invention comprises an angle sensor for individually outputting a crank angle signal and a cylinder identification signal by detecting the rotational angle of an internal combustion engine; and a control/arithmetic operation circuit for calculating the control parameters of the internal combustion engine based on the crank angle signal and the cylinder identification signal and outputting drive signals to the actuators of the internal combustion engine according to the control parameters, wherein the crank angle signal includes pulses corresponding to the first and second reference crank angles of the respective cylinders of the internal combustion engine; and the cylinder identification signal includes a pulse having a phase difference to the crank angle signal as well as the pulse number created from the second reference crank angle to the first reference crank angle of a next cylinder is different from that of other cylinders as to at least a specific cylinder, and the control/arithmetic operation circuit includes timing calculation means for calculating the control timing; count means for counting the pulse number of the cylinder identification signal detected from the second reference crank angle to the first reference crank angle; cylinder identification assessment means for assessing how the respective cylinders are identified based on the count value of the pulse number and a previous count value and outputting a cylinder identification flag as a result of the assessment; and control reflection means for reflecting the value of the cylinder identification flag to the output state of the drive signals, wherein the control reflection means prohibits the output of the drive signals when the cylinder identification flag does not correspond to any of the respective cylinders.

In the internal combustion engine controller according to the present invention, the first reference crank angle corresponds to the timing at which an initial current supply starts; the second reference crank angle corresponds to the timing at which initial ignition is executed in the vicinity of a compression upper dead point; and the pulse number of the cylinder identification signal is set to 0, 1 or 2 in correspondence with the respective cylinders.

In the internal combustion engine controller according to the present invention, when the combination of the count value and the previous count value does not correspond to any of the respective cylinders, the cylinder identification assessment means sets the value of the cylinder identification flag to a maximum value corresponding to an abnormal state.

In the internal combustion engine controller according to the present invention, the control/arithmetic operation circuit includes cycle ratio calculation means for calculating a cycle ratio based on the present value and the previous value of the pulse cycle of the crank angle signal; and abnormal rotation discrimination means for creating a discrimination signal showing an abnormally rotating state when the cycle ratio deviates from a predetermined range, wherein the control reflection means prohibits the output of the drive signals in response to the discrimination signal.

Further, in the internal combustion engine controller according to the present invention, the cycle ratio calculation means calculates the cycle ratio $\alpha$ using the present value Ti(n) and the previous value Ti(n−1) of the pulse cycle by the formula: $\alpha=Ti(n-1)/\{Ti(n)+Ti(n-1)\}$ and the abnormal rotation discrimination means compares the cycle ratio $\alpha$ with a predetermined value K and when $\alpha \geqq K$ is satisfied, the abnormal rotation discrimination means outputs the discrimination signal.

DESCRIPTION OF THE PREFERRED EMBODIMENTS

Embodiment 1

Figure 1:
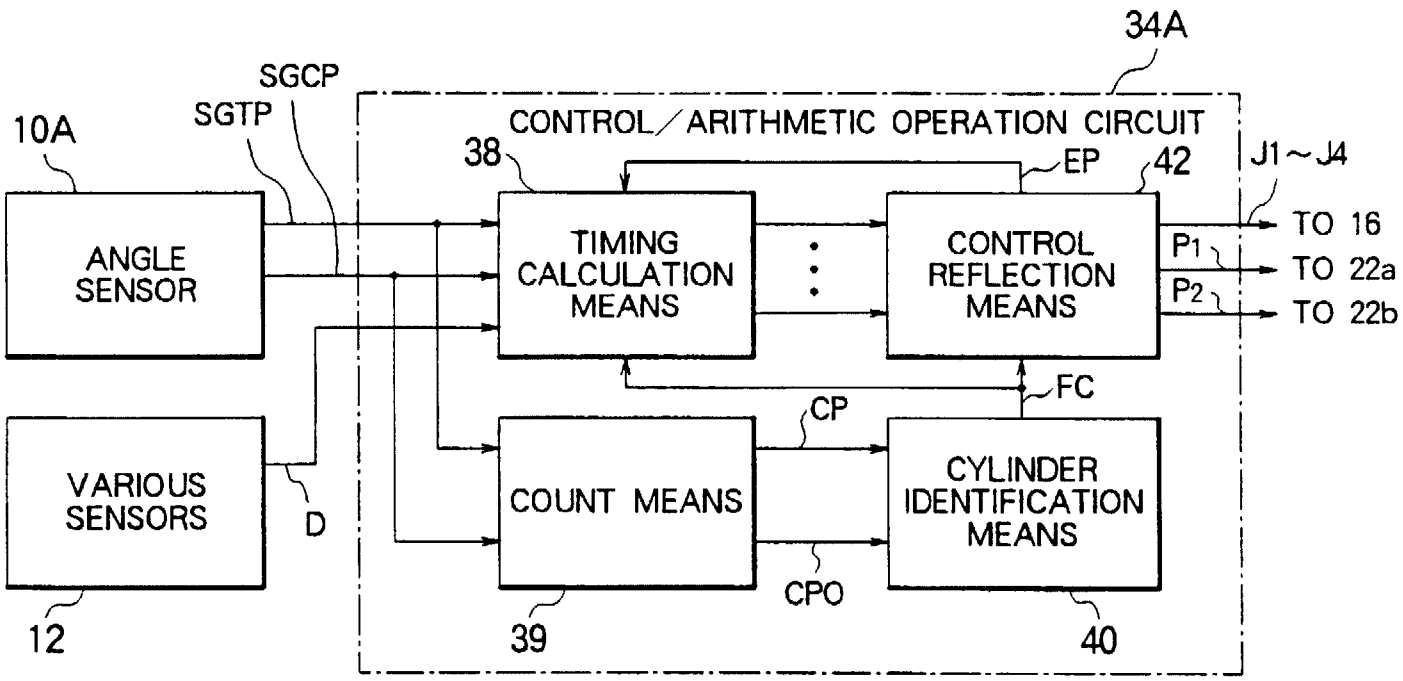
FIG. 1 is a block diagram showing the main portion of an embodiment 1 of the present invention.

An embodiment 1 of the present invention will be described with reference to the drawings. FIG. 1 is a block diagram showing the main portion of the embodiment 1 of the present invention, wherein various sensors 12, injectors 16, power transistors 22*a*, 22*b* are the same as those mentioned above.

Figure 2:
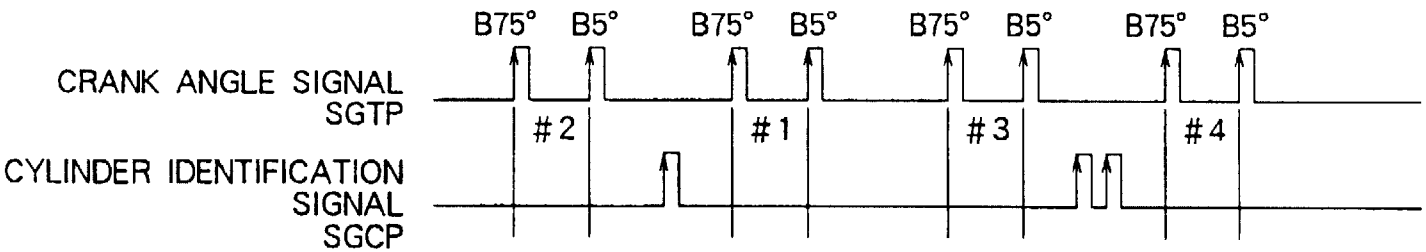
FIG. 2 is a timing chart showing the waveforms of signals output from an angle sensor in the embodiment 1 of the present invention.
Figure 3:
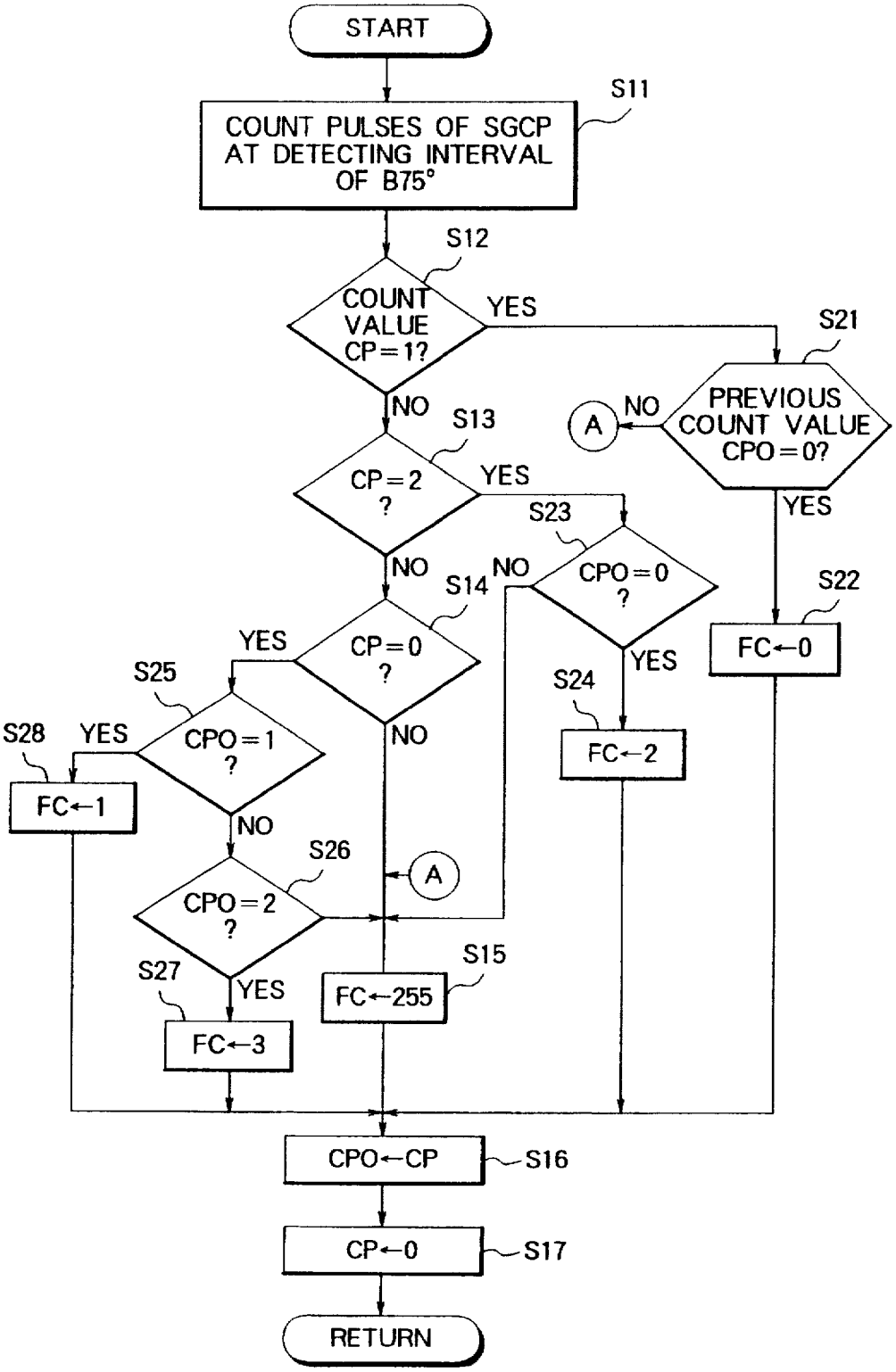
FIG. 3 is a flowchart showing cylinder discriminating operation executed by the embodiment 1 of the present invention.
Figure 4:
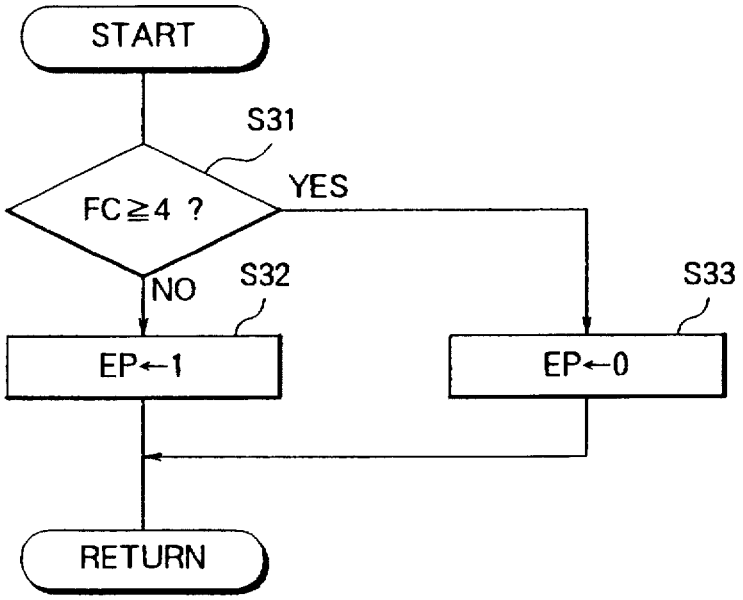
FIG. 4 is a flowchart showing control reflecting operation resulting from cylinder identification executed by the embodiment 1 of the present invention.

FIG. 2 is a timing chart showing the waveforms of signals output from an angle sensor in FIG. 1. FIG. 3 is a flowchart showing cylinder identification assessment operation executed by the embodiment 1 of the present invention, and FIG. 4 is a flowchart showing reflecting operation according to a result of the cylinder identification assessment operation.

Figure 9:
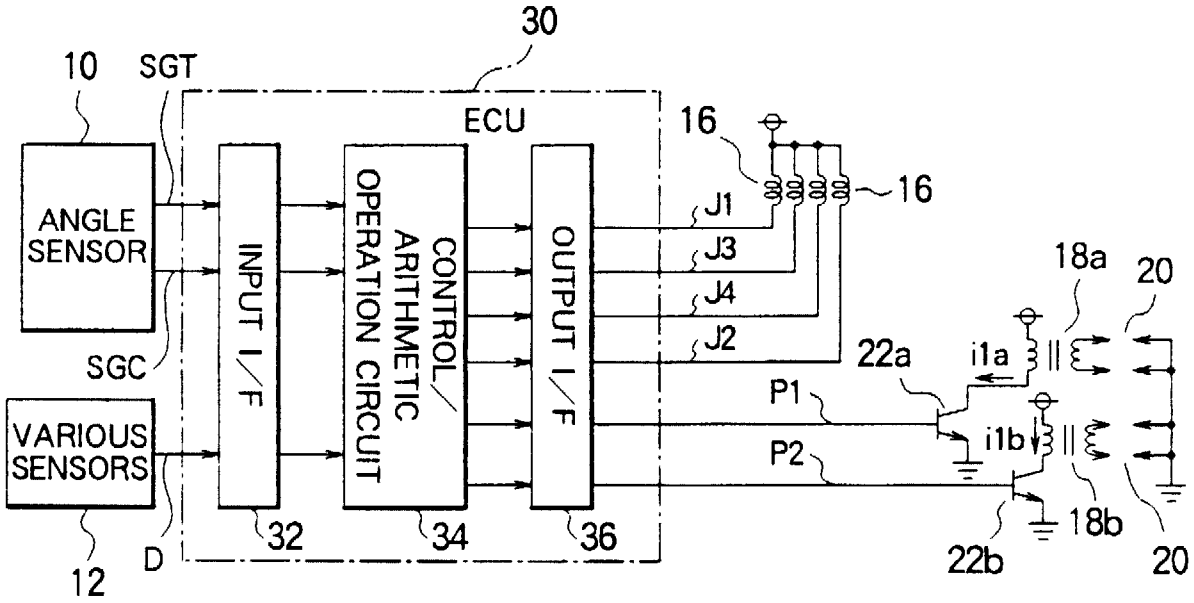
FIG. 9 is a view showing the arrangement of a conventional internal combustion engine controller.
Figure 10:
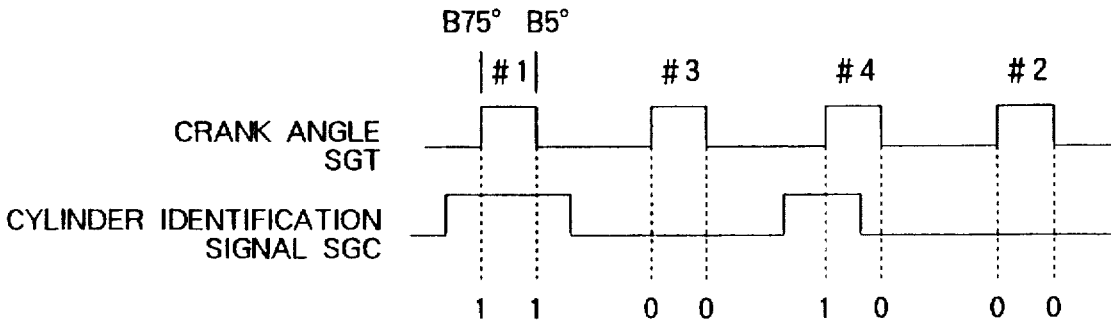
FIG. 10 is a timing chart showing the waveforms of signals output from an angle sensor in the conventional internal combustion engine controller.
Figure 11:
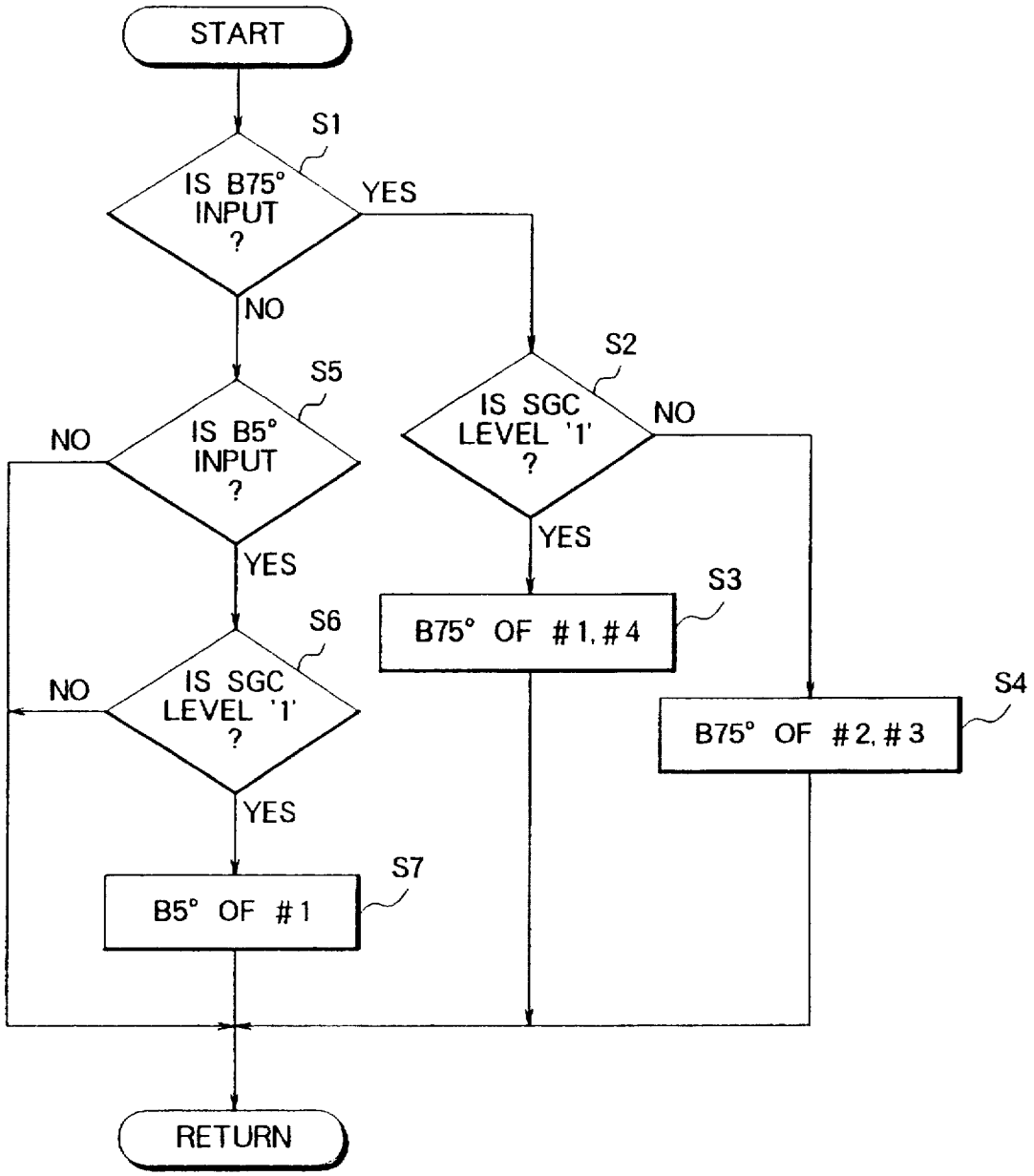
FIG. 11 is a flowchart showing cylinder discriminating operation executed by the conventional internal combustion engine controller.
Figure 12:
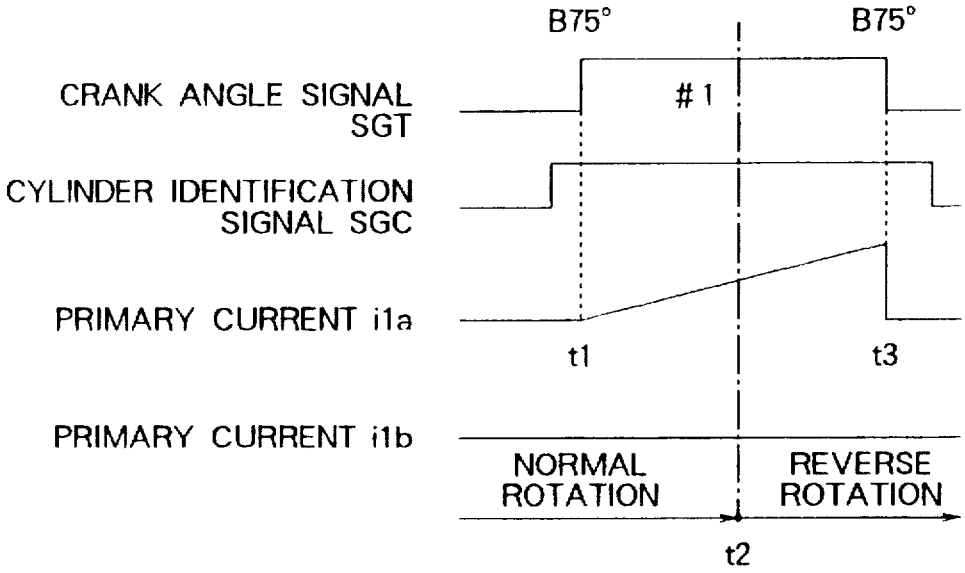
FIG. 12 is a timing chart explaining primary current supply operation when reverse rotation occurs in the conventional internal combustion engine controller.
Figure 13:
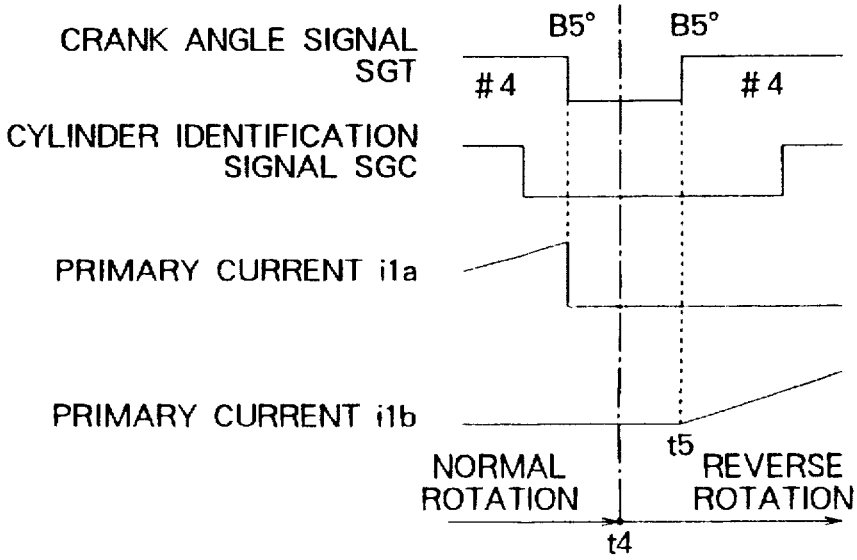
FIG. 13 is a timing chart explaining the primary current supply operation when the reverse rotation occurs in the conventional internal combustion engine controller.

Note, the components (an ECU 30, an input interface 32, an output interface 36 and the like) which are omitted here and not shown in FIG. 1 are arranged similarly to those shown in FIG. 9.

Although an ignition controller applied to group sparking is described here as an example, it is needless to say that the ignition controller is also applicable to any device having an individual power transistor and an ignition coil provided with each of cylinders so long as the device is of a lower power distribution type.

In FIG. 1, the crank angle sensor in an angle sensor 10A is composed of electromagnetic pickups disposed in correspondence to, for example, the respective reference crank angles B75° and B5° of a crank angle and a wave shaping circuit for converting the signals output from the electromagnetic pickups to pulses and the cylinder identification sensor in the angle sensor 10A is composed of an electromagnetic pickup disposed in correspondence to the position of a particular cylinder on a cam shaft and a wave shaping circuit for converting the signal output from the electromagnetic pickup to pulses.

Therefore, the angle sensor 10A outputs a crank angle signal SGTP including the pulses corresponding to the first and second reference crank angles B75° and B5° of the respective cylinders of an internal combustion engine and a cylinder identification signal SGCP including pulses having a phase difference to the crank angle signal SGTP as shown in FIG. 2.

In FIG. 2, the rising edges of the respective pulses of the crank angle signal SGTP are allocated to the first reference crank angles B75° and the second reference crank angles B5° of the respective cylinders.

The cylinder identification signal SGCP is arranged such that the number of pulses created from one of the second reference crank angles B5° to the first reference crank angle B75° of a next cylinder is different as to at least a particular cylinder from the pulse numbers of other cylinders.

In FIG. 2, the pulse number is set to "one" as to the #2 cylinder, to "2" as to the #3 cylinder, and to "0" as to the #1 and #4 cylinders, so that each cylinder can be specified by referring to a previous pulse number.

In FIG. 1, a control/arithmetic operation circuit 34A includes a timing calculation means 38 for calculating the timings at which the respective actuators (injectors 16 and ignition coils) are controlled according to the signal output from the angle sensor 10A and an operating state D, count means 39 for calculating the pulse numbers CP of the cylinder identification signal SGCP detected from the second reference crank angles B5° to the first reference crank angles B75°, cylinder identification assessment means 40 for assessing how the respective cylinders are identified based on the present count value CP of the pulse number and a previous count value CPO and outputting a cylinder identification flag FC as a result of the assessment and control reflection means 42 for reflecting the value of the cylinder identification flag FC to the output state of drive signals J1–J4 and P1 and P2.

The control reflection means 42 recognizes a cylinder identification result and the assessment result of the above cylinder identification result from the cylinder identification flag FC and outputs the drive signals (J1–J4, P1 or P2) to the cylinder indicated by the cylinder identification flag FC as well as when the cylinder identification flag FC does not correspond to any of the #1–#4 cylinders, the control reflection means 42 clears an ignition enable flag EP to 0 to thereby prohibit the output of the drive signals J1–J4, P1 and P2.

Next, cylinder identification processing operation and reflection processing operation of the cylinder identification result executed by the embodiment 1 of the present invention shown in FIG. 1 will be described with reference to the flowcharts of FIG. 3 and FIG. 4 together with the timing charts of FIG. 2 and FIG. 5.

Figure 5:
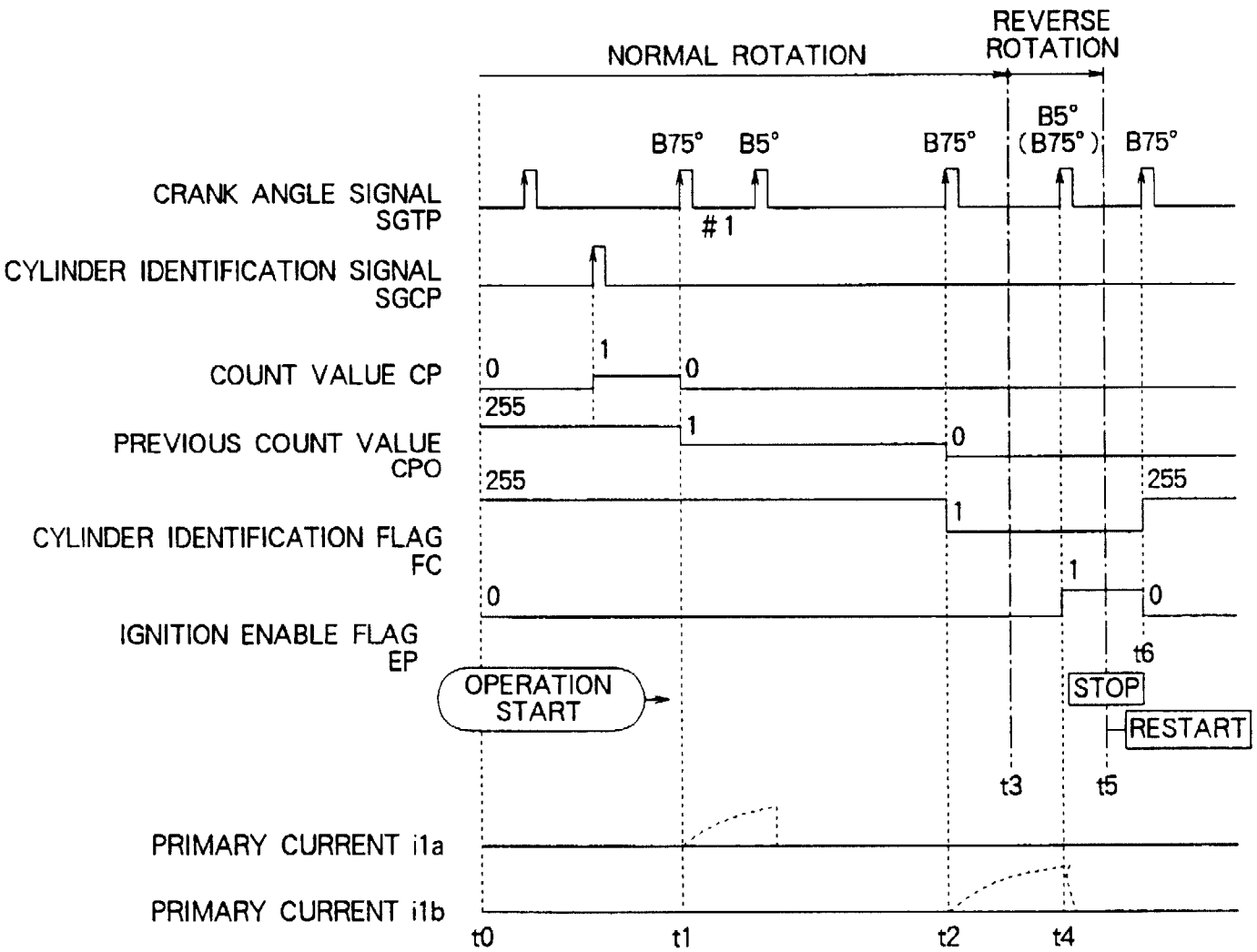
FIG. 5 is a timing chart explaining control reflecting operation executed by the embodiment 1 of the present invention.

FIG. 5 shows the timings at which the cylinder identification flag FC and the erroneous operation preventing ignition enable flag EP operate and how primary currents i1*a* and i1*b* are supplied (the output state of the drive signals P1 and P2) as to a case that the internal combustion engine starts at a time t0, is reversed at a time t3, stops at a time t5 and then starts again.

Note, the cylinder identification routine in FIG. 3 corresponds to the count means 39 and the cylinder identification assessment means 40 in the control/arithmetic operation circuit 34A and is operated by the interrupt processing of the first reference crank angle B75°. At the time, when the present count value CP is obtained between the previous pulse and the present pulse of the crank angle signal SGTP, it is determined that the rising edge of the present pulse is the first reference crank angle B75°.

Further, the cylinder identification reflection routine of FIG. 4 corresponds to the control reflection means 42 in the control/arithmetic operation circuit 34A and operated by the interrupt processing of the second reference crank angle B5° after the cylinder identification assessment processing of FIG. 5. At the time, when the count value CP is not obtained from the previous pulse to the present pulse of the crank angle signal SGTP, it is determined that the rising edge of the present pulse is the second reference crank signal B5°.

In FIG. 3, steps S11, S16 and S17 shows processing operation executed by the count means 39 and steps S12–S15 and S21–S28 shows processing operation executed by the cylinder identification assessment means 40.

First, it is assumed that the count value CP in the count means 39 is cleared to "0", the previous count value CPO and the cylinder identification flag FC in the cylinder identification assessment means 40 are set to a value of at least "4" as initial values (for example, a maximum value "255") and the ignition enable flag EP in the control reflection means 42 is cleared to 0 (ignition disable state) by the operation of a start switch at the start of the internal combustion engine.

The count means 39 counts the pulse number of the cylinder identification signal SGCP in the region where the first reference crank angle B75° is detected and the cylinder identification signal SGCP is output each time the first reference crank angle B75° is detected (step 11).

At the time, the count value CP is set to "1", "0" and "2", respectively in normal rotation when the first reference crank angles B75° of the #1, #3, #4 cylinders are detected as apparent from FIG. 2.

Next, the cylinder identification assessment means 40 determines whether the present count value CP is "1" or not (step S12) and when it is determined that the present count value CP is not "1" (that is, NO), the cylinder identification assessment means 40 determines whether the present count value CP "2" or not (step S13) and when it is determined that the present count value CP is not "2" (that is, NO), the cylinder identification assessment means 40 determines whether the present count value CP is "0" or not (step S14).

At step S14, if it is determine that the present count value CP is not "0" (that is, NO), the cylinder identification assessment means 40 recognizes that an abnormal state in which no cylinder can be identified arises and sets "255" as the cylinder identification flag FC (step S15).

The count means 39 sets the count value CP at present as the previous count value CPO (step S16), clears the present count value CP to 0 (step S17) and then the process returns though the routine shown in FIG. 3.

If it is determined at step S12 that CP=1 (that is, YES), it is determined whether the previous count value CPO is "0" or not (step S21) and if it is not "0" (that is, NO), the process goes to abnormal state processing step S15, whereas if it is determine that CPO=0 (that is, YES), the cylinder identification flag FC is set to "0" (corresponding to the #1 cylinder) (step S22) and the process goes to step S16 at which the previous count value CPO is set.

If it is determined at step S13 that CP=2 (that is, YES), it is determined whether the previous count value CPO is "0" or not (step S23) and if it is determined that the previous count value CPO is not "0", the process goes to abnormal state processing step S15, whereas if it is determined that CPO=0 (that is, YES), the cylinder identification flag FC is set to "2" (corresponding to the #4 cylinder) (step S24) and the process goes to step S16.

If it is determined at step S14 that CP=0 (that is, YES), it is determined whether the previous count value CPO is "1" or not (step S25) and if it is determined that the previous count value CPO is not "1" (that is, NO), it is subsequently determined whether the previous count value CPO is "2" or not (step S26).

If it is determined at step S26 that the previous count value CPO is not "2" (that is, NO), the process goes to abnormal processing step S15, whereas if it is determined that CPO=2 (that is, YES), the cylinder identification flag FC is set to "3" (corresponding to the #2 cylinder) (step S27) and the process goes to step S16.

If it is determined at step S25 that CPO=1 (that is, YES), the cylinder identification flag FC is set to "1" (corresponding to the #3 cylinder) (step S28) and the process goes to step S16 at which the previous count value CPO is set.

The thus obtained cylinder identification flag FC is used by the timing calculation means 38 as the timing at which the actuator of each cylinder is controlled.

In FIG. 4, the control reflection means 42 determines whether the cylinder identification flag FC has a value of "4" or more referring to the cylinder identification flag FC (step S31).

If it is determined that the value of the cylinder identification flag FC is a value of "3" or less (that is, NO), the result of cylinder identification is regarded as normal, the ignition enable flag EP is set to "1" (step S32) and the respective actuator drive signals are made to an output permitted state and the process returns. Therefore, the internal combustion engine is ordinarily controlled by the drive signals J1–J4, P1 and P2 from the control/arithmetic operation circuit 34A.

If it is determined at step S31 that the cylinder identification flag FC is set to "255" and FC≧4 (that is, YES), since the result of cylinder identification is regarded as abnormal, the ignition enable flag EP is cleared to "0" (step S33), the respective actuator drive signals are made to an output prohibited state and the process returns.

Since the output of the drive signals J1–J4, P1 and P2 is prohibited by the establishment of EP=0 in response to FC=255 as described above, the abnormal control of the internal combustion engine and the damage thereof by the erroneous control can be prevented.

FIG. 5 shows a specific example of the cylinder identification and ignition enable operation. In FIG. 5, when the internal combustion engine starts at the time t0, the count value CP and the ignition enable flag EP are set to "0" and the previous count value CPO and the cylinder identification flag FC are set to "255".

Subsequently, the above processing routine (FIG. 3) operates at the time t1 at which the first reference crank angle B75° is detected after one pulse of the cylinder identification signal SGCP is detected, the previous count value CPO is set to "1" and the count value CP is cleared to "0". At the time, the cylinder identification flag FC remains "255" and the ignition enable flag EP remains "0" even at the next second reference crank angle B5°.

Therefore, the primary current i1*a* (see a dotted line) does not start to be supplied at the time t1.

Subsequently, the processing routine of FIG. 3 operates at the time t2 at which the next first reference crank angle B75° is detected in a state that the pulse of the cylinder identification signal SGCP is not detected, the previous count value CPO is set to "0" and the count value CP is cleared to "0" as well as the cylinder identification flag FC is set to "1" by step S28 (see FIG. 3).

At the time, since the interrupt routine (FIG. 4) is not operated by the next second reference crank angle B5°, the ignition enable flag EP remains "0" and the primary current i1*b* (see a dotted line) does not start to be supplied.

Next, when the internal combustion engine is reversed at the time t3, although the first reference crank angle B75° is detected again as the pulse of the crank angle signal SGTP at the time t4 after the reverse rotation, the control/arithmetic operation circuit 34A erroneously recognizes the first reference crank angle B75° as the second reference crank angle B5° and sets the ignition enable flag EP to "1" (control permitted state).

However, since the primary current i1*a* did not start to be supplied at the previous first reference crank angle B75°, ignition is not executed at an excessively advanced angle at the second reference crank angle B5°.

Next, when the internal combustion engine is restarted from a state that it is stopped at the time t5 after it is reversed from this side of a compression upper dead point (TDC) (between B75° and B5°), the processing routine of FIG. 3 operates at the time t6 at which the first reference crank angle B75° is detected while the cylinder identification signal SGCP is not yet detected.

At the time, since both the present count value CP and the previous count value CPO are set to "0", the cylinder identification assessment means 40 sets the cylinder identification flag FC to "255" (abnormal state), to thereby cause the control reflection means 42 to clear the ignition enable flag EP to "0".

Therefore, even if the internal combustion engine is reversed when it starts, since the control of it by the control/arithmetic operation circuit 34A is prohibited, the internal combustion engine is not erroneously controlled when it starts at a next time.

Since the cylinder identification flag FC is set to the abnormal value "255" and the ignition enable flag EP is set to "0" (ignition disabled) at the start, actual cylinder identification is not finished until the first reference crank angle B75° is detected three times. Thus, the primary currents i1*a* and i1*b* are not erroneously supplied in an unidentified state.

Therefore, the erroneous control can be further prevented.

Since the pulse number of the cylinder identification signal SGCP is counted in the region on this side of the first reference crank angle B75° at which reverse rotation is difficult to be caused, the reliability of the count value CP is not lowered.

Further, since the cylinder identification flag FC is set to the maximum value "255" when the abnormal state of any cylinder is identified, the control reflection means 42 can prohibit the control by easily recognizing the abnormal state.

As described above, erroneous control can be prevented by promptly identifying a cylinder and discriminating whether the identification is correct or not from the count value CP of the pulses of the cylinder identification signal SGCP detected between the respective crank angles B75° and B5° and the previous count value CPO.

Further, the control/arithmetic operation circuit 34A can be simply arranged because it is sufficient that the count means 39 has a small counting capacity as well as it suffices for the cylinder identification assessment means 40 to execute a simple determination processing whether the count values CP and CPO are "0", "1" or "2" in this case. Thus, a cost is not increased.

Note, the ignition enable flag EP may be output to an external unit when necessary to show the occurrence of the abnormal state and the like.

Embodiment 2

Note, although the embodiment 1 prohibits the output of the drive signals by that the control reflection means 42 responds only to the abnormal value of the cylinder identification flag FC, the output of the drive signals may be prohibited by that the control reflection means 42 also responds to an abnormal state discrimination signal based on the cycle ratio of the crank angle signal SGTP.

Figure 6:
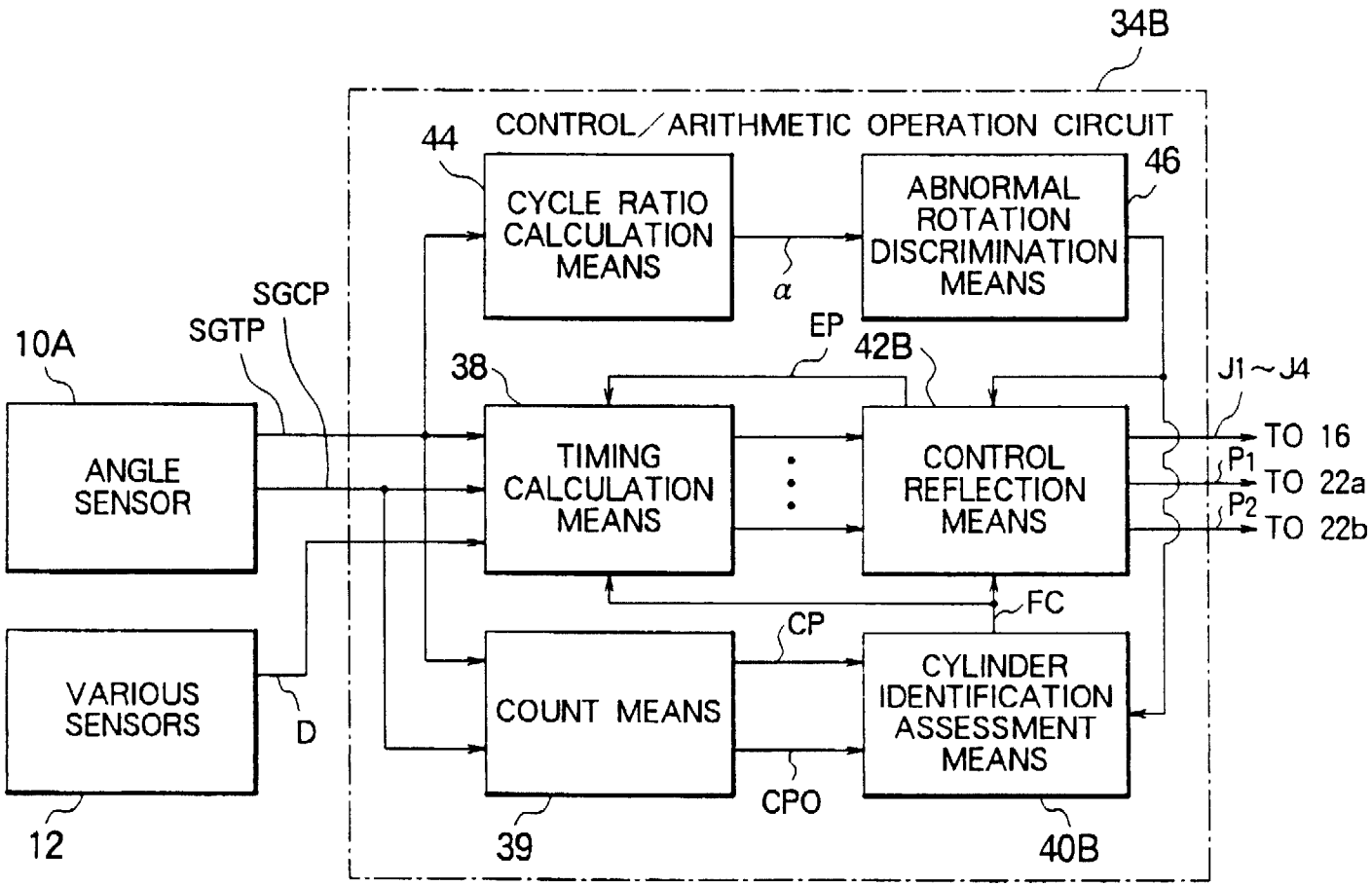
FIG. 6 is a block diagram showing the main portion of an embodiment 2 of the present invention.

FIG. 6 is a block diagram showing the main portion of a second embodiment 2 of the present invention arranged such that control reflection means also responds to the cycle ratio. In the drawing, the same numerals are used to denote the components similar to those mentioned above and the description thereof is omitted.

Figure 7:
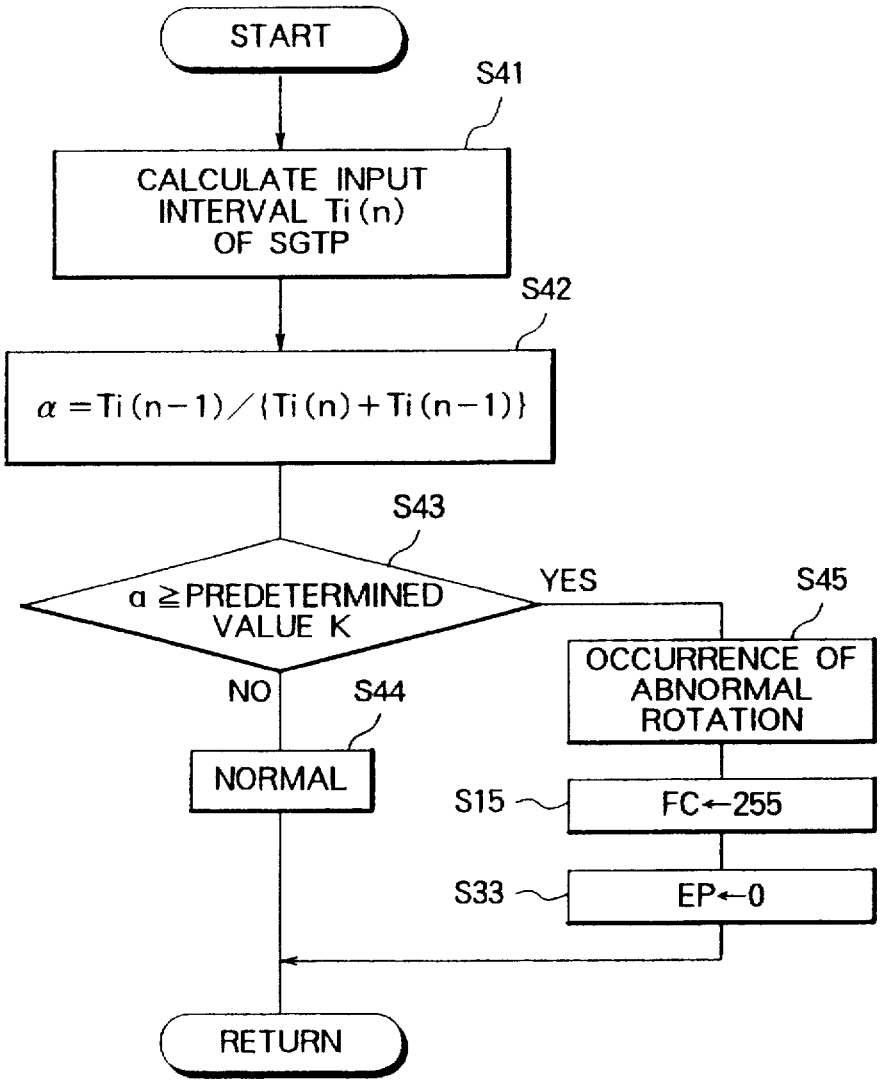
FIG. 7 is a flowchart showing abnormal rotation discriminating operation executed by the embodiment 2 of the present invention.
Figure 8:
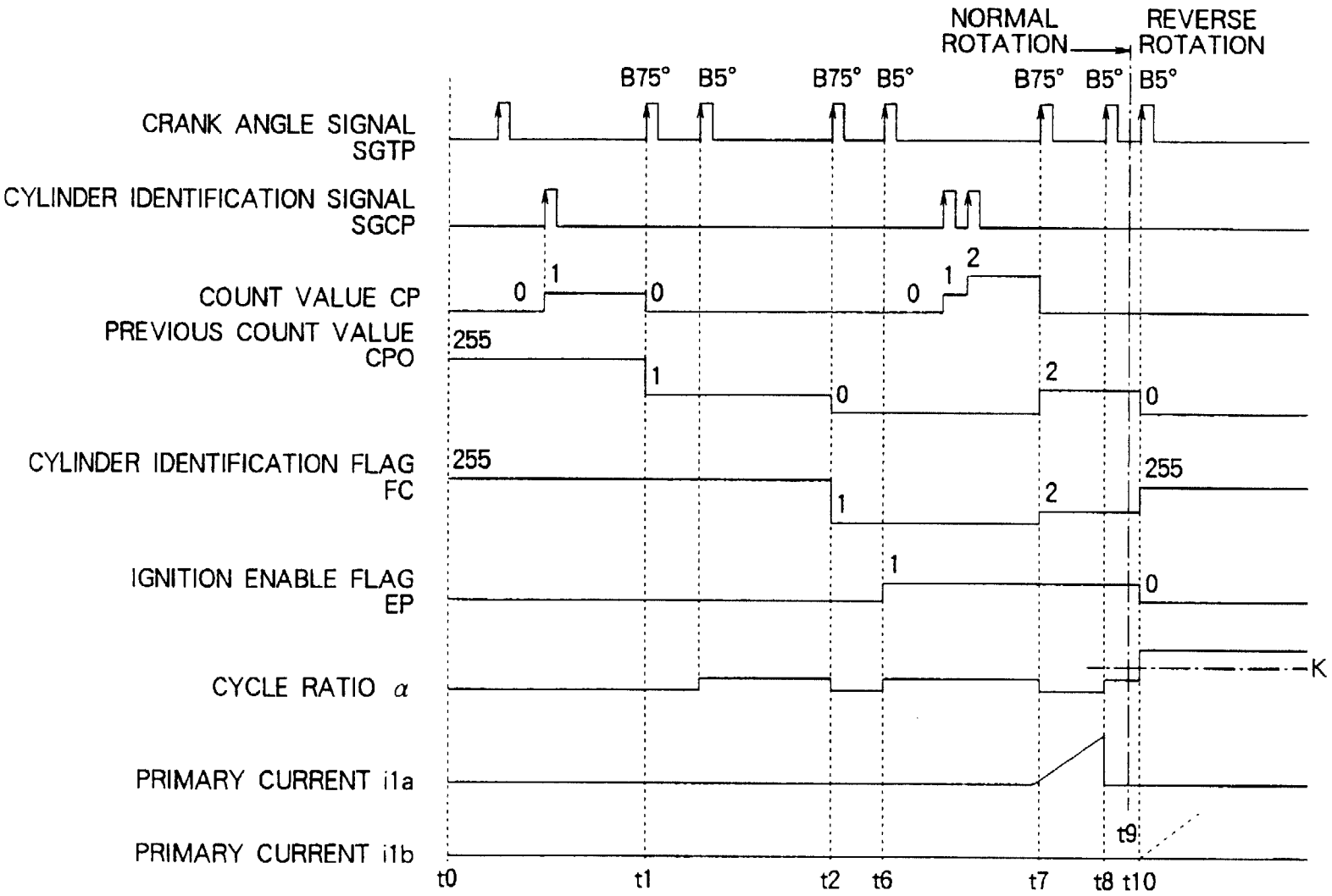
FIG. 8 is a timing chart explaining control reflecting operation by the discrimination of abnormal rotation executed by the embodiment 2 of the present invention.

FIG. 7 is a flowchart showing cycle ratio calculation operation executed by control/arithmetic operation means in FIG. 6, and FIG. 8 is a timing chart showing operation executed by the embodiment 2 of the present invention when abnormal rotation occurs.

FIG. 7 shows an interrupt routine executed at respective reference crank angles B75° and B5°. Steps S15 and S33 are similar to those in the embodiment 1 (see FIG. 3 and FIG. 4).

In this case, the control/arithmetic operation circuit 34B includes cycle ratio calculation means 44 for calculating a cycle ratio α based on the present value and the previous value of the pulse cycle of the crank angle α signal SGTP and abnormal rotation discrimination means 46 for creating an discrimination signal E showing an abnormally rotating state caused when the cycle ratio α deviates from a predetermined range.

Control reflection means 42B prohibits the output of the drive signals J1–J4, P1 and P2 by responding not only to the abnormal value of the cylinder identification flag FC but also to the discrimination signal E.

Cylinder identification assessment means 40B sets the cylinder identification flag FC to the abnormal value "255" in response to the discrimination signal E.

Next, cycle ratio calculating operation and control reflecting operation executed by the embodiment 2 of the present invention shown in FIG. 6 will be described with reference to the timing chart of FIG. 8 together with the flowchart of FIG. 7.

In FIG. 7, cycle ratio calculation means 44 first calculates the input interval (cycle) Ti(n) of the respective pulses of the crank angle signal SGTP (step S41) and calculates the cycle ratio α of a previous value Ti(n−1) to the sum of the previous value Ti(n−1) and a present value Ti(n) as shown by the following formula (step S42).

$$\alpha = Ti(n-1)/\{Ti(n)+Ti(n-1)\} \quad (1)$$

At the time, when the internal combustion engine is in normal rotation, since the first and second reference crank angles B75° and B5° are alternately detected, the cycle ratio α (≦1) is set to the rotation time ratio of 70° and 110° to a crank angle 180° (70/180 or 110/180), that is a value of about ½.

On the other hand, when reverse rotation occurs by the turning-off of the start switch, since the pulse (for example, B5°) of the crank angle signal SGTP is detected again just after the same pulse is detected, the detection interval of this time (pulse cycle) is shortened and the cycle ratio α shows a value near to 1.

Subsequently, the abnormal rotation discrimination means 46 determines whether the cycle ratio α is equal to or greater than a predetermined value K or not (step S43) and if the cycle ratio α is smaller than the predetermined value K, (that is, NO), the abnormal rotation discrimination means 46 regards the rotating state of the internal combustion engine as a normally rotating state and does not output the discrimination signal E (step S44) and the process returns.

Whereas, if it is determined that α≧K (that is, YES) at step S43, the abnormal rotation discrimination means 46 regards that an abnormally rotating state occurs in the internal combustion engine and outputs the discrimination signal E (step S45).

With this operation, the process goes to processing step to be taken when the abnormal state occurs, the cylinder discrimination assessment means 40B sets the cylinder identification flag FC to the abnormal value "255" (step S15), the control reflection means 42B clears the ignition enable flag EP to 0 (step S33) to thereby prohibit the output of the drive signals J1–J4, P1 and P2 from the control/arithmetic operation means 34B and then the process returns.

FIG. 8 shows a specific example of the erroneous control preventing operation. Since the operation start time t0 and the times t1 and t2 at which the first reference crank angle B75° is detected at first and second times are the same as those of the aforesaid example (see FIG. 5), the description of them is omitted here.

Since it is assumed here that normal rotation is continued even after the time t2 at which the cylinder identification flag FC is set to "1", the ignition enable flag EP is set to "1" (control permitted) at the time t6 at which the next second reference crank angle B5° is detected.

Subsequently, the cylinder discrimination assessment means 40 sets the cylinder identification flag FC to "2" (corresponding to the #4 cylinder) at step S24 described above (see FIG. 3) referring to the previous count value CPO (=0) at the time t7 at which the first reference crank angle B75° is detected three times after the pulse number of the cylinder identification signal SGCP is counted and the count value CP is incremented to "2".

Therefore, the ignition drive signal P1 is output to the #4 cylinder at the time t7 and the primary current i1*a* starts to be supplied.

Thereafter, it is assumed that the second reference crank angle B5° is detected at a time t8 and reverse rotation occurs at a time t9 just after the primary current ia1 is shut off.

At the time, since the second reference crank angle B5° is detected again at once, the cycle ratio α which is calculated at the time t10 at which the second reference crank angle B5° just after the reverse rotation abruptly increases and exceeds the predetermined value K as shown in FIG. 8.

Therefore, the abnormal rotation discrimination means 46 outputs the discrimination signal E at the time t10 and the control reflection means 42B clears the ignition enable flag EP to "0" and the cylinder identification assessment means 40B sets the cylinder identification flag FC to the abnormal value "255" in response to the discrimination signal E.

As described above, since the output of the drive signals J1–J4, P1 and P2 from the control/arithmetic operation circuit 34B is prohibited when the cycle ratio α shows an abnormal value, the erroneous supply of the primary current i1*b* caused by abnormal rotation such as reverse rotation can be prevented (see a dotted line in FIG. 8). Thus, the erroneous control of the internal combustion engine can be further securely prevented.

Note, the predetermined value K serving as a comparison reference at step S43 may be set to any arbitrary value from ½ to 1 such as, for example, about 0.8.

Although the cycle ratio α is calculated by the formula (1) in the embodiment 2, it is needless to say that abnormal rotation can be discriminated likewise by determining the cycle ratio α from an arbitrary calculation formula and setting a comparison discrimination formula and the predetermined value K corresponding to the calculation formula.

What is claimed is:

1. An internal combustion engine controller, comprising:

an angle sensor for individually outputting a crank angle signal and a cylinder identification signal by detecting the rotational angle of an internal combustion engine; and a control/arithmetic operation circuit for calculating the control parameters of the internal combustion engine based on the crank angle signal and the cylinder identification signal and outputting drive signals to the actuators of the internal combustion engine according to the control parameters, wherein:

the crank angle signal includes pulses corresponding to the first and second reference crank angles of the respective cylinders of the internal combustion engine; and the cylinder identification signal includes a pulse having a phase difference to the crank angle signal as well as the pulse number created from the second reference crank angle to the first reference crank angle of a next cylinder is different from that of other cylinders as to at least a specific cylinder, and said control/arithmetic operation circuit includes:

timing calculation means for calculating the control timing;

count means for counting the pulse number of the cylinder identification signal detected from the second reference crank angle to the first reference crank angle;

cylinder identification assessment means for assessing how the respective cylinders are identified based on the count value of the pulse number and a previous count value and outputting a cylinder identification flag as a result of the assessment; and control reflection means for reflecting the value of the cylinder identification flag to the output state of the drive signals, wherein said control reflection means prohibits the output of the drive signals when the cylinder identification flag does not correspond to any of the respective cylinders.

2. An internal combustion engine controller according to claim 1, wherein:

the first reference crank angle corresponds to the timing at which an initial current supply starts;

the second reference crank angle corresponds to the timing at which initial ignition is executed in the vicinity of a compression upper dead point; and the pulse number of the cylinder identification signal is set to 0, 1 or 2 in correspondence with the respective cylinders.

3. An internal combustion engine controller according to claim 1, wherein when the combination of the count value and the previous count value does not correspond to any of the respective cylinders, said cylinder identification assessment means sets the value of the cylinder identification flag to a maximum value corresponding to an abnormal state.

4. An internal combustion engine controller according to claim 1, wherein said control/arithmetic operation circuit includes:

cycle ratio calculation means for calculating a cycle ratio based on the present value and the previous value of the pulse cycle of the crank angle signal; and abnormal rotation discrimination means for creating a discrimination signal showing an abnormally rotating state when the cycle ratio deviates from a predetermined range, wherein said control reflection means prohibits the output of the drive signals in response to the discrimination signal.

5. An internal combustion engine controller according to claim 4, wherein said cycle ratio calculation means calculates the cycle ratio α using the present value Ti(n) and the previous value Ti(n−1) of the pulse cycle by the formula:

$$\alpha = Ti(n-1)/\{Ti(n)+Ti(n-1)\} \quad (1)$$

and said abnormal rotation discrimination means compares the cycle ratio α with a predetermined value K and when $\alpha \geqq K$ is satisfied, said abnormal rotation discrimination means outputs the discrimination signal.

* * * * *

UNITED STATES PATENT AND TRADEMARK OFFICE

CERTIFICATE OF CORRECTION

PATENT NO. : 5,794,592

DATED : August 18, 1998

INVENTOR(S) : Wataru Fukui

It is certified that error appears in the above-identified patent and that said Letters Patent is hereby corrected as shown below:

IN THE CLAIMS:

1. An internal combustion engine controller, comprising:

an angle sensor for individually outputting a crank angle signal and a cylinder identification signal by detecting the rotational angle of an internal combustion engine; and a control/arithmetic operation circuit for calculating [the] control parameters of the internal combustion engine based on the crank angle signal and the cylinder identification signal and outputting drive signals to [the] actuators of the internal combustion engine according to the control parameters, wherein:

the crank angle signal includes pulses corresponding to [the] first and second reference crank angles of [the] respective cylinders of the internal combustion engine; and the cylinder identification signal includes a pulse signal having a phase difference to the crank angle signal, wherein the number of pulses [as well as the pulse number] created from the second reference crank angle of a first cylinder to the first reference crank angle of a [next] second cylinder is different at least from the number of pulses from the second reference crank angle of the second cylinder to the first reference crank angle of a third cylinder [that of other cylinders as to at least a specific cylinder], and said control/arithmetic operation circuit includes:

UNITED STATES PATENT AND TRADEMARK OFFICE

CERTIFICATE OF CORRECTION

PATENT NO. : 5,794,592

DATED : August 18, 1998

INVENTOR(S) : Wataru Fukui

It is certified that error appears in the above-identified patent and that said Letters Patent is hereby corrected as shown below:

timing calculation means for calculating [the] a control timing;

count means for counting the pulse number of the cylinder identification signal detected from the second reference crank angle to the first referenced crank angle;

cylinder identification assessment means for assessing how the respective cylinders are identified based on [the] a count value of the pulse number and a previous count value and outputting a cylinder identification flag [as a result of the assessment]; and control reflection means for reflecting [the] a value of the cylinder identification flag [to the output state of] in the drive signals, wherein said control reflection means prohibits [the] output of the drive signals when the cylinder identification flag does not correspond to any of the respective cylinders.

| | | |
|---|---|---|
| Claim 2, | line 3, | change "the" (second occurrence) to --a--; |
| | line 5, | change "the" (second occurrence) to --a--; |
| | line 9, | delete "in correspondence with" to --for--. |
| Claim 3, | line 2, | change "the" (first occurrence) to --a--. |
| Claim 4, | line 3, | change "includes" to --comprises--; |
| | line 5, | change "the" (both occurrences) to --a--; |
| | line 8, | change "abnormally" to --abnormal--. |

Signed and Sealed this

Ninth Day of February, 1999

*Attest:*

*Attesting Officer*

*Acting Commissioner of Patents and Trademarks*